US010464105B2

(12) United States Patent
Koistinen et al.

(10) Patent No.: US 10,464,105 B2
(45) Date of Patent: Nov. 5, 2019

(54) METHOD, APPARATUS AND SYSTEM FOR SORTING WASTE

(71) Applicant: METROSENSE OY, Vantaa (FI)

(72) Inventors: Oskari Koistinen, Helsinki (FI); Hannu Karhuketo, Tuusula (FI); Göran Sundholm, Tuusula (FI)

(73) Assignee: METROSENSE OY, Vantaa (FI)

( * ) Notice: Subject to any disclaimer, the term of this patent is extended or adjusted under 35 U.S.C. 154(b) by 0 days.

(21) Appl. No.: 15/501,943

(22) PCT Filed: Aug. 12, 2015

(86) PCT No.: PCT/FI2015/050522
§ 371 (c)(1),
(2) Date: Feb. 6, 2017

(87) PCT Pub. No.: WO2016/024043
PCT Pub. Date: Feb. 18, 2016

(65) Prior Publication Data

US 2017/0225199 A1 Aug. 10, 2017

(30) Foreign Application Priority Data

Aug. 13, 2014 (FI) ..... 20145716

(51) Int. Cl.
*B07C 5/34* (2006.01)
*B65F 1/00* (2006.01)
*B65F 1/14* (2006.01)

(52) U.S. Cl.
CPC ..... *B07C 5/3412* (2013.01); *B65F 1/0006* (2013.01); *B65F 1/1484* (2013.01);
(Continued)

(58) Field of Classification Search
CPC ..... B07C 5/3412; B07C 5/344; B07C 2301/0016; B07C 2501/0054; B03B 5/16;
(Continued)

(56) References Cited

U.S. PATENT DOCUMENTS 5,299,693 A 4/1994 Ubaldi et al.
5,423,431 A 6/1995 Westin
(Continued)

FOREIGN PATENT DOCUMENTS

CN 2597109 Y 1/2004
CN 102378727 A 3/2012
(Continued)

OTHER PUBLICATIONS

International Search Report (PCT/ISA/210) issued in PCT/FI2015/050522, dated Nov. 20, 2015.
(Continued)

*Primary Examiner* — Joseph C Rodriguez
(74) *Attorney, Agent, or Firm* — Birch, Stewart, Kolasch & Birch, LLP

(57) ABSTRACT

A method for sorting waste, in which waste or recyclable material intended for sorting is brought in waste bags to a sorting apparatus, which includes a conveyor, from which the waste bags belonging to different waste components are separated from each other by guiding them into the containers according to the waste components or to further processing. A waste bag, an identifier arranged in connection with it and/or the content of the waste bag is identified with a sensor system, which includes a number of sensors monitoring different properties, which sensors essentially simultaneously read and/or identify a waste bag, an identifier arranged in connection with it and/or the content of the waste bag when the waste bag is transferred on the conveyor via the reading area of the sensors, and in which method on
(Continued)

the basis of information coming from the sensors the waste bags are sorted into different waste components using one or more handling devices of the sorting apparatus. The invention also relates to an apparatus and to a system.

31 Claims, 5 Drawing Sheets

(52) U.S. Cl.
CPC ..... *B07C 2501/0054* (2013.01); *B65F 2210/1123* (2013.01); *B65F 2210/14* (2013.01)

(58) Field of Classification Search
CPC ..... B65F 1/1484; B65F 2210/112; B65F 2210/1123; B65F 2210/1125; B65F 2210/1126; B65F 2210/1128; B65F 2210/138; B65F 2210/152; B65F 2210/1525; B65F 2210/1527
See application file for complete search history.

(56) References Cited

U.S. PATENT DOCUMENTS

| | | | | |
|---|---|---|---|---|
| 5,610,516 | A * | 3/1997 | Maier | B65F 1/14 324/226 |
| 6,811,030 | B1 * | 11/2004 | Compton | B65F 1/0033 209/2 |
| 6,842,596 | B2 * | 1/2005 | Morii | G03G 15/00 241/24.1 |
| 8,204,620 | B2 * | 6/2012 | Mallett | A61L 11/00 700/236 |
| 9,090,399 | B2 * | 7/2015 | Sundholm | B07C 5/3412 |
| 9,098,884 | B2 * | 8/2015 | Borowski | B65F 1/0066 |
| 9,405,992 | B2 * | 8/2016 | Badholm | B07C 5/3412 |
| 9,639,535 | B1 * | 5/2017 | Ripley | G06K 9/627 |
| 9,707,595 | B2 * | 7/2017 | Ripley | B07C 5/3412 |
| 10,198,653 | B2 * | 2/2019 | Kotula | G06K 9/20 |
| 2007/0208455 | A1 | 9/2007 | Bollegraaf et al. | |
| 2008/0029445 | A1 | 2/2008 | Russcher et al. | |
| 2012/0010746 | A1 | 1/2012 | Sundholm | |
| 2012/0168354 | A1 | 7/2012 | Sundholm | |
| 2012/0234924 | A1 | 9/2012 | Sundholm | |
| 2016/0187188 | A1 * | 6/2016 | Curotto | G06Q 10/30 177/136 |
| 2016/0247058 | A1 * | 8/2016 | Kreiner | B07C 5/3412 |
| 2017/0011364 | A1 * | 1/2017 | Whitman | B65D 21/086 |
| 2017/0174439 | A1 * | 6/2017 | Ripley | B65G 43/08 |

FOREIGN PATENT DOCUMENTS

| | | | | |
|---|---|---|---|---|
| CN | 102378728 | A | 3/2012 | |
| CN | 102574161 | B | 3/2016 | |
| EP | 0 759 816 | A1 | 3/1997 | |
| JP | 6-511185 | A | 12/1994 | |
| JP | 8-157007 | A | 6/1996 | |
| JP | 8-318225 | A | 12/1996 | |
| JP | 3114915 | B2 | 12/2000 | |
| JP | 2013-504503 | A | 2/2013 | |
| WO | WO 90/11142 | A1 | 10/1990 | |
| WO | WO 95/32062 | A1 | 11/1995 | |
| WO | WO 03/039773 | A1 | 5/2003 | |
| WO | WO 2006/096101 | A1 | 9/2006 | |
| WO | WO 2010/112669 | A1 | 10/2010 | |
| WO | WO 2011/029991 | A2 | 3/2011 | |
| WO | WO 2012134389 | A1 * | 10/2012 | B07C 5/342 |
| WO | WO-2016097014 | A1 * | 6/2016 | B07C 5/3412 |

OTHER PUBLICATIONS

Written Opinion (PCT/ISA/237) issued in PCT/FI2015/050522, dated Nov. 20, 2015.
English translation of Chinese Search Report, dated Jul. 24, 2018, for Chinese Application No. 201580042379.5.
Japanese Office Action, dated Jul. 16, 2019 for Japanese Application No. 2017-507870, with an English translation.

* cited by examiner

METHOD, APPARATUS AND SYSTEM FOR SORTING WASTE

FIELD OF THE INVENTION

The invention relates generally to waste handling and more particularly to the sorting of waste.

The object of the invention is a method of sorting waste containers based on a closure of the waste container having an identification device indicating the contents of the container.

Another object of the invention is an apparatus wherein a waste container has a closure with an identification device indicating the contents of the container.

The object of the invention is also a system wherein a waste container has a closure with an identification device indicating the contents of the container is sorted by handling devices receiving the contents of the waste container by sensors reading the identification device.

BACKGROUND OF THE INVENTION

Nowadays it is typical, e.g. in respect of household waste, that households use as waste bags different bags, sacks or carrier bags, in which waste is placed. For example, in Finland it is normal to use plastic bags from shops, in which bags shopping has been brought home, as waste bags. The waste is carried in plastic carrier bags to the waste bin, into which typically the carrier bag, and its contents, closed with a knot is placed. The waste is transported onwards for further processing by a garbage truck. In modern systems one disadvantage, among others, is that the sorting of wastes is awkward. It is often possible that users do not bother to sort waste into its different components, but instead mix all waste in the same waste bag or waste bin. In this case mixed waste is produced, the reclamation of which is difficult.

Known in the art are solutions for sorting waste, in which solutions different types of waste are arranged to be transported in different containers, such as in waste bags or bins of different colors. For example, households place different types of waste in waste bags of different colors. A waste bag of a specific color is specified for each type of waste. Waste is transported e.g. in a normal garbage truck to a waste center, where the waste is sorted on the basis of the colors of the waste bags into different components. The sorting of waste optically is described in publication EP0759816. A drawback here is that there must be waste bags separately arranged for the purpose for each waste type to be sorted. Another drawback is also the uncertainty of operation of the automatic optical sorting apparatus used in sorting the waste bags in a dirty environment. The sorting of waste is described in publication WO03039773 A1. Also known in the art are solutions wherein wastes, more particularly waste bags, are provided with an RFID identifier and the wastes are taken to a sorting center or corresponding, in which is a sorting apparatus provided with a sensor that reads the information of the RFID identifier of the waste, more particularly of the waste bag. The information read by the sensor is transmitted to the sorting apparatus, which sorts the different waste components on the basis of the RFID identifier. This type of solution is presented e.g. in publication WO 2011/029991 A2. A method and means in handling waste is also known in the art from publication WO2010/112669 A1, wherein an RFID identifier and visual identifiers are arranged in the closing means of a waste bag, on the basis of the information provided by which identifiers the waste bags can, inter alia, be sorted into waste components.

One problem, among others, in prior art is that all waste bags are not necessarily provided with an identifier in the manner hoped for by the user, or the identifier has been damaged, in which case the sorting of waste in a waste station is made more difficult. In addition, some unsuitable material, e.g. metal, might have been mixed in amongst the different waste components, and this can be detrimental to the later use of the sorted material. In further processing, e.g. when incinerating waste, undesirable material, e.g. metal, can be mixed in amongst the waste to be incinerated, and this is detrimental to the functioning of the incineration process in a waste incineration plant.

In addition, the flexibility and adaptability of sorting in the solutions known in the art have sometimes been awkward.

The aim of the invention is to achieve a new type of solution in the sorting of wastes, by means of which the problems of prior art can be avoided.

BRIEF DESCRIPTION OF THE INVENTION

The invention is based on a concept in which waste bags are conducted to a sorting apparatus via a reading area of a sensor system, which the sensor system comprises a number of sensors, which simultaneously read or identify a waste bag, an identifier arranged in connection with a waste bag and/or the material that is in a waste bag, and the information acquired in which identification is transmitted to a sorting apparatus, which sorts the different waste components in the desired manner on the basis of the identification.

The solution according to the invention has a number of important advantages. On the basis of the simultaneous reading or identification by a number of the sensors of the sensor system of a waste bag, of at least one identifier arranged in connection with a waste bag and/or the material of a waste bag, which information is transmitted to the sorting apparatus, to the control system of it, the waste bags are sorted into waste components in the desired manner. By means of the primary identifier, an RFID identifier, the operation, such as sorting, of the system can be controlled efficiently. The secondary identifier, which an optical sensor is preferably adapted to optically identify, can sort waste also in a case in which a primary identifier, e.g. an RFID identifier, is missing from a waste bag. In addition, by using material identification, e.g. metal detection, as one sensor of the sensor system, the desired material component can be effectively identified and also a waste bag containing undesired material can be prevented from getting mixed in the sorting into the waste component indicated by an identifier. With this solution the undesired sorting of a waste bag containing e.g. metal into the body of a waste component intended for incineration can be avoided. According to one embodiment the sensor system or sorting apparatus can further comprise so-called more advanced measuring technologies for material identification, e.g. an X-ray analyzer or an NMR analyzer or a material identification device based on some other such technology based on penetrating radiation. With these methods and apparatuses it can be possible also to identify different types of materials. In this case the purity of the waste and accuracy of the sorting can be effectively ensured insofar as the waste bag actually contains the waste component that according to the identifier it should. Arranging an identifier in the closing means of a waste bag enables the use of any bag, carrier bag, sack, or corresponding whatsoever in waste transport and does not require special separate transport containers intended for specific waste components. In this case only one input point can be conveniently used for different materials in connection with the waste transport system, in which case wastes are sorted in the system later, e.g. in a waste center, a sorting center or corresponding, into different components according to an RFID identifier. At the same time, feeding of waste material without an RFID identifier according to the invention, into an input point of the system can also, if necessary, be prevented, e.g. by arranging the door of the waste room to open only by means of an RFID identifier.

In the waste sorting center, to which the waste bags are transported conventionally with garbage trucks or in some other way, such as with a pneumatic waste transfer system, the waste bags are sorted into different waste components on the basis of the information provided by the identifiers and/or on the basis of the indicated material. After this according to one embodiment the waste bags are ripped open and, if necessary, the bags are removed from the rest of the waste. In this case it is possible to avoid bags ending up at a landfill site. The material of the bags can be recycled and reused. Preferably a dedicated RFID identifier and/or an identifier comprising a visual identifier is arranged for each waste component, on the basis of which identifier the waste components can be separated from each other. Recycleable paper, for instance, is handled in a corresponding manner. In this case paper, such as newspapers, is placed in a bag and it is closed with a closing means according to the invention, the closing means comprising an RFID identifier.

An RFID identifier can be used to register the amount of waste produced by a certain user, in which case the invoicing basis can be changed. On the other hand, a waste producer can be rewarded for sorting waste, e.g. by reducing the waste transport fees of waste that is fit for recycling.

The invention can thus be utilized by using the ordinary plastic carrier bags of a shop that are provided with a closing means according to the identifier, or with a bag that already comprises an identifier. The carrier bag is filled with waste and closed by knotting its carrying loops.

Using an identifier, according to the invention, that indicates the waste component in pneumatic pipe transportation has the advantage that a dedicated input point for different waste components is not needed, but instead all waste bags can be fed into the same input point. In normal waste transport, waste bins of only a single type are needed, and only one garbage truck collects them instead of 3-4 trucks. It is also advantageous if all wastes, such as mixed waste, biowaste, glass waste, metal waste and paper waste, are placed into a bag. In this case different waste components stay clean and their transportation is easier. The bag to be used as a transportation container is, if necessary, separated from the waste component in the sorting center.

The invention can be applied according to one preferred embodiment so that each household or other waste-producing community or corresponding is supplied with its own closing means, which closing means comprise RFID identifiers. This assists sorting. In addition, by means of the combination of a closing means and RFID identifier according to the invention, it is easy to demonstrate where the costs of the waste handling system are incurred. Fees can thus be allocated to waste producers more accurately than earlier.

According to one preferred embodiment, households have a fixed waste charge and receive a credit for each waste bag sorted in a sorting center. Based on the automatic reading of RFID identifiers, the system can allocate the sorted waste by means of an information system so that the credit goes to the correct target.

Sorting on the basis of an identifier in a sorting center is very easy, as also is identification of a household. Arranging an identifier on a waste bag or in its closing means thus gives numerous opportunities in waste sorting. Using in the sorting apparatus a sensor system comprising a number of sensors, which simultaneously identify and/or read a waste bag, an identifier of a waste bag and/or the material of a waste bag, enhances and improves the sorting result. In addition, control of the handling devices of the sorting apparatus on the basis of the information or signals transmitted by the sensors of the sensor system can optimize reliable identification of the waste components better than before.

The versatile identification system according to the invention, said system comprising a number of sensors, enables optimization of the control of the sorting plant in different loading circumstances or during exceptional or servicing situations.

According to one embodiment, it is advantageous to construct the sorting plant in such a way that it comprises at least two parallel handling lines, in a larger plant many handling lines. It is easy to run an automated sorting plant at a lower capacity, when one or more sorting lines are at a standstill, because operation can be guided to lines that are still running.

According to one embodiment, all the robots functioning as handling devices do not, in practice, extend to perform sorting of all the fractions, but typically one robot functioning as a handling device is able to transfer waste bags in a sorted manner into from two to four different components. The handling devices are thus, in a way, specialized in certain waste components, but mainly the operating ability of the handling devices that are side-by-side is such that they are able to, at least partly, replace another handling device. If a lot of bags of the same component happen to come consecutively onto a single line, a situation can arise in which e.g. in a plant of eight robots, only one or two robots are performing sorting work and the others are standing still because "their own waste" is not coming. For this, smart control according to the invention is needed. By means of a detector system comprising a number of sensors, an abundance of information is obtained about the properties of waste bags intended for sorting and about the content of said bags, and that information is used in the invention by means of a smart control system to employ the available sorting capacity optimally by guiding the material flows suitably with the handling devices and/or with the conveyor.

The smart system according to the invention comprises numerous algorithms for controlling the sorting plant according to the situation. In addition, the system can be self-learning, contain adaptive algorithms and develop its own operation continuously.

In this application "waste bag" refers to a bag, carrier bag or sack, in which waste or material intended for recycling is arranged.

BRIEF DESCRIPTION OF THE FIGURES

In the following, the invention will be described in detail by the aid of some embodiments with reference to the attached drawings, wherein.

DETAILED DESCRIPTION OF THE INVENTION

Figure 2:
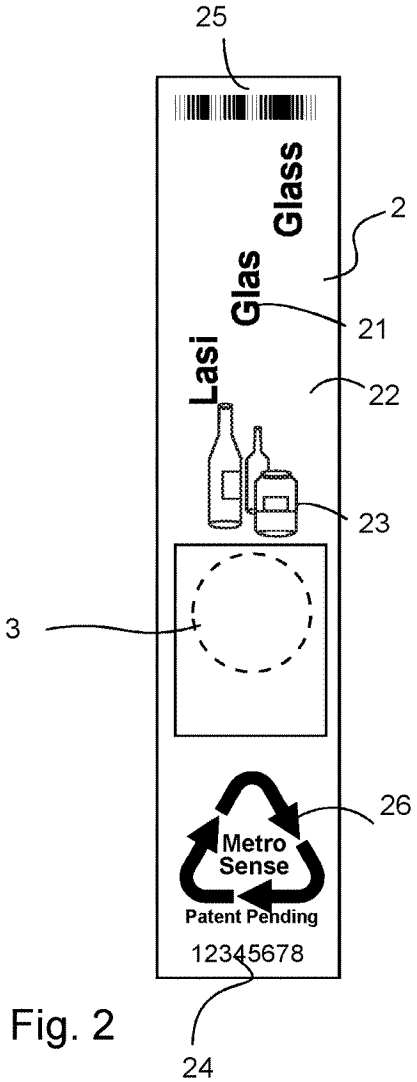
FIG. 2 presents a closing means of a waste bag, the closing means comprising identifiers and being applicable in an embodiment of the invention.

In the invention waste material or recycleable material is placed in a waste bag, which is provided with an identifier 3, or to which an identifier 3 is attached e.g. to the closing means of the waste bag. A waste producer, such as a household, company or other community, pre-sorts the wastes that it produces into waste bags 1 and provides each bag 1 containing a sortable waste type with a closing means 2 comprising an identifier 3 according to the type of waste, or arranges the waste into a bag 1 that is provided in advance with an identifier 3, which can be an RFID identifier or a visual identifier or some other machine-readable identifier. Depending on the application, the waste types can be e.g. mixed waste, biowaste, paper, glass, metal, cardboard, hazardous waste, etc. Typically, each type of sortable waste, i.e. waste component F1 . . . Fn, has its own identifier, in which the type of waste the identifier 3 is intended for can be visually seen or otherwise sensed. In addition, an identifier can comprise other information, e.g. a customer code or corresponding, which is individual to each waste-producer community, such as to a household, company or other community. The corresponding information is coded into the memory of the RFID identifier. FIG. 2 presents one example of a closing means 2, comprising an RFID identifier 3 and visual, preferably machine-readable, identifiers. In addition to an RFID identifier 3, the closing means 2 is also provided with other identifiers 21, 22, 23, 24, 25, 26. In the embodiment of FIG. 2 the closing means comprises a text marking 21, which indicates in words the type of waste for which the closing means in question is intended. The verbal marking 21 can be made in a number of different languages. A color code 22 is formed on the surface of the closing means 2, which color code can be a part of the area of the closing means or the size of the whole closing means. In addition, the closing means 2 can comprise a picture code or drawing code 23, which indicates the type of waste for which the closing means is intended. The closing means can comprise a customer code 24, which indicates the waste-producer community, such as a household, company or community. The customer code 24 is typically alphanumeric information. Furthermore, the closing means can comprise a barcode 25 or other visible graphical code. Furthermore, the closing means of waste groups intended for recycling can comprise a code descriptive of recycling. In addition, the closing means 2 can comprise the information or advertisements of a manufacturer or marketer. Furthermore, the closing means can comprise the name or other identifier of a local waste management company or community. Corresponding identifier information, which FIG. 2 presents in connection with a closing means 2, can be marked directly on a waste bag or on an identification means, such as a sticker, to be attached to the waste bag.

An RFID identifier can be arranged in a closing means in ways that are, per se, known in the art. The closing means 2 can be fully according to the color fitted for each waste component F1 . . . Fn or the color in question can be impressed or printed onto its surface. Correspondingly, other markings can be printed or otherwise formed on the closing means. An RFID identifier 3 and other visual identifiers 21, 22, 23, 24, 25, 26 can be arranged alternatively on a waste bag 1 itself or on a part to be connected to the waste bag.

Figure 1:
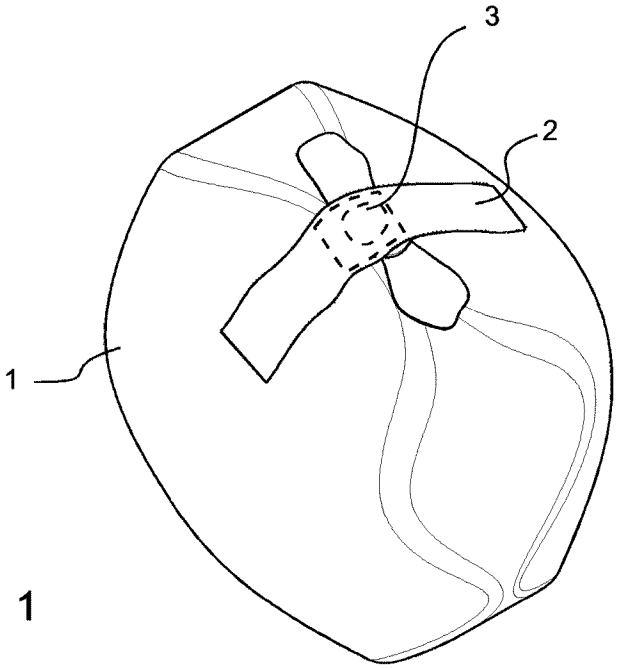
FIG. 1 presents a combination of a waste bag and an identifier applicable in a system according to the invention.

FIG. 1 presents a waste bag 1, to which a closing means 2 is fixed, which closing means is provided with an identifier 3. The closing means 2 is arranged in the embodiment of the figure over a knot formed in the waste bag 1, in which case it prevents opening of the knot during transportation. The knot is formed e.g. by knotting the carrying loops of the bag 1. The closing means 2 comprises an adhesive surface on the side against the outer surface of the bag 1, in which case it sticks to the outer surface of the bag.

The closing means in the case of FIG. 1 comprises a base part, onto which the RFID identifier 3 is arranged in a manner that is, per se, known in the art. The base is preferably of paper-based material, sticker laminate or corresponding, which can be fixed to the waste bag 1 easily owing to the adhesive surface. The RFID identifier 3 comprises a memory part (chip) and an antenna part. The RFID identifier is preferably a passive RFID identifier, in which case it does not need its own power source.

Alternatively, the closing means 2 can be used as a closer of the mouth part of a conventional waste sack, by winding it tightly around the mouth part. If so desired, the mouth part can still be knotted or provided with an additional closer.

A waste producer, such as a household, takes a waste bag 1 provided with an identifier 3 according to the waste type to an input point of the system, such as to a waste bin situated in a waste room.

The combination of a closing means 2 of a waste bag and an RFID identifier 3 can be utilized in connection with a waste transport system e.g. as follows. Closing means according to the invention, i.e. combinations of a closing means and an RFID identifier, are distributed or otherwise delivered to households or other waste producers. The RFID identifier comprises the code or corresponding identifier of each waste producer, with which code the waste producer can, if necessary, be identified. According to one preferred embodiment, the closing means 2 comprises an identification code, such as a color code, according to which the closing means is used in the system in the manner agreed in connection with each sorted waste bag. The color code can be the size of the whole closing means or a pattern or text. It is conceivable that a color code of a certain color is defined for mixed waste, a second color code for biowaste, correspondingly own color codes for recycleable materials. In this case users equip a waste bag comprising a certain type of waste with a closing means that comprises a corresponding color code. One closing means is presented in FIG. 2 and its identifiers 3, 21, 22, 23, 24, 25, 26 are described in the preceding.

In this way the waste bag wanted by the user can be used in connection with any different waste component whatsoever, and a waste producer marks a waste bag 1 only with a color code of a closing means 2 and of an RFID identifier 3 according to one preferred embodiment of the invention. Typically also an RFID identifier also already comprises in advance the waste type in connection with which it is used.

The waste bags 1 can be transported in the desired manner, e.g. on a waste transport vehicle or with a pneumatic conveying system, to the reception center for wastes, where the wastes are sorted into different waste components F1 . . . Fn with the sorting apparatus according to the invention. In addition, the empty waste bags 1 used for transportation of the waste can be separated into their own waste component after the emptying of the waste.

Figure 3:
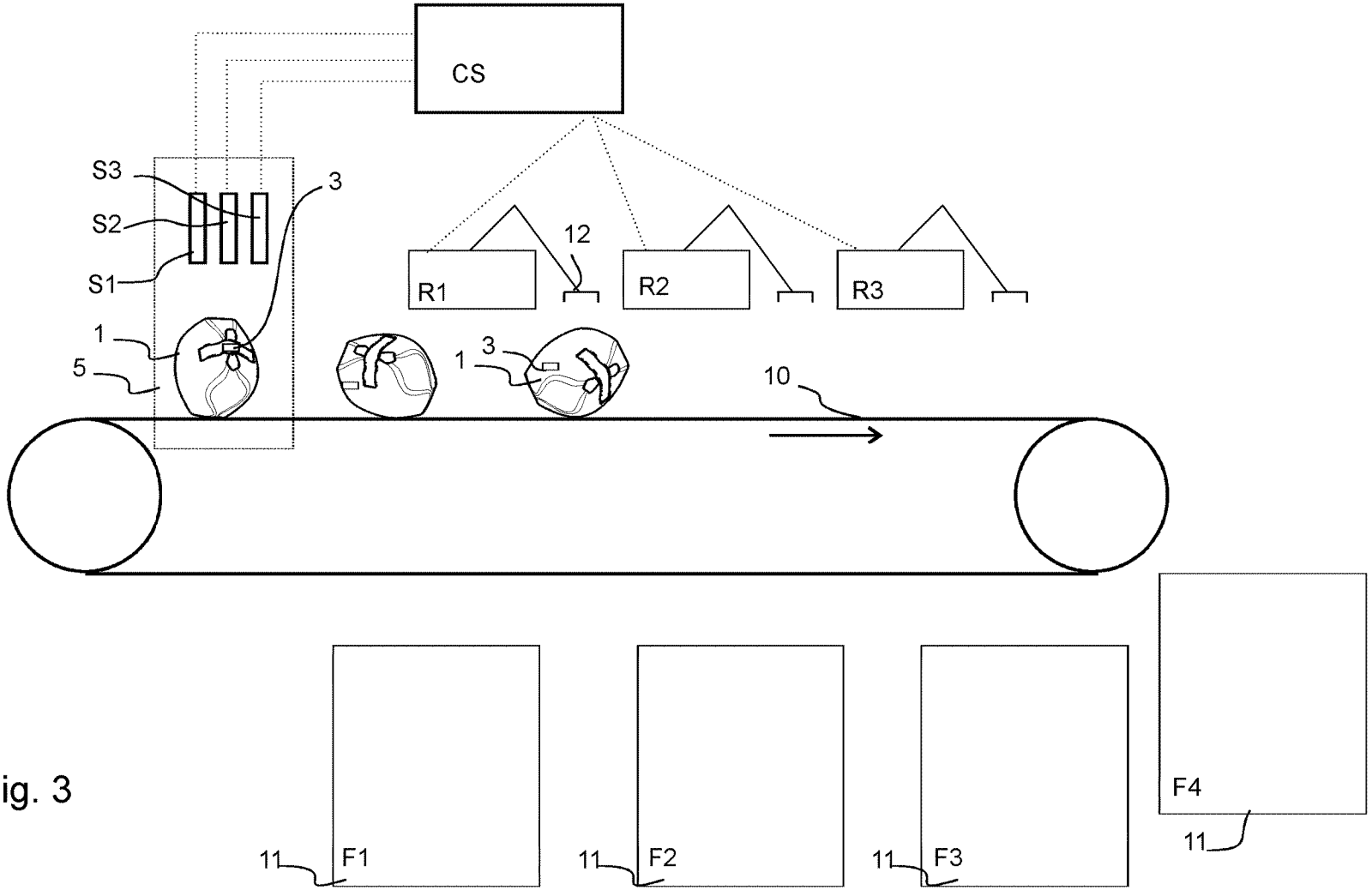
FIG. 3 presents a simplified and diagrammatic side view of an apparatus of an embodiment of the invention.

FIG. 3 presents a simplified and diagrammatic view of a waste sorting apparatus according to one embodiment of the invention. The waste bags 1 are fed into the sorting apparatus onto the conveyor 10. A reading area 5 of the sensor system is arranged alongside the route of the conveyor 10, a number of sensors S1, S2, S3 being arranged in which area. There can be more sensors than the sensors marked in the figure, but for the sake of clarity only three sensors S1, S2, S3 are marked in the figure. On the basis of the information read or received by a sensor S1, S2, S3, the handling devices R1, R2, R3 can be controlled. Handling devices R1 . . . Rn are thus arranged alongside the route of the conveyor 10, which handling devices are able to grip a waste bag 1 with a gripper 12 and to lift the waste bag 1 from the conveyor 10 and to transfer a waste bag 1 that contains waste to the container 11 intended for the waste component in question. There can be a conveyor or other transfer device between the handling apparatus and the container 11.

The conveyors 10 and handling devices R1 . . . Rn are presented in the figures without support structures in order to increase the clarity of the figures. In the embodiment of the figures the handling devices R1 . . . Rn are sorting robots. Gripping means 12 are arranged on the arm of the handling devices. In addition, on the arm or in the reading area of the sensor system in connection with the conveyor, or elsewhere, there can be a detector apparatus, such as a camera, by means of which the position of a waste bag or the size of a waste bag on the conveyor can be detected. After this the handling device is able to turn the gripper in such a way that the picking movement is performed according to the actual location of the waste bag. In addition, in a special case the handling devices can be controlled to function according to the requirements set by the size of a waste bag.

In FIG. 3 the sensors S1, S2, S3 are, for the sake of clarity, presented as being consecutive, although the typical location of them is side-by-side, in which case they are adapted to essentially simultaneously identify and/or read a waste bag in the reading area 5, an identifier arranged in connection with a waste bag and/or the material that is in a waste bag. The sensors S1, S2, S3 do not necessarily have a sequence, but instead they can function essentially simultaneously and can perform possibly hundreds of measurements per second. The sensors S1, S2, S3 can be arranged in a gate-type structure, in which case the waste bags 1 are conducted through the gate in question in the reading area 5. On the basis of the properties of the sensors S1, S2, S3, the reading area 5 can be provided with walls and a roof, e.g. for reducing disturbances.

Sorting occurs with the handling devices R1, R2, R3 arranged in connection with the conveyor 10, which devices are controlled on the basis of the signals coming from the sensors of the sensor system. On the basis of the information of an RFID identifier, visual identifier and/or the indicated material read by the sensors, a command is transmitted for transferring the waste of the waste bags to the handling devices R1, R2, R3 intended for the different waste components for transporting onwards into the containers 11 intended for the different waste components F1 . . . Fn.

Since it is assumed that e.g. 10-20% of the waste bags are partly or wholly broken, assorted detached waste therefore moves on the conveyor belt, in addition to the waste bags. In this case, when using handling devices that are of the type that only push the waste bag of the waste component in question to the side, it causes at the same time also other detached waste that is on the conveyor belt to go along. This is undesirable for achieving satisfactory sorting.

The solution according to an embodiment of the invention is that a handling device R1 . . . Rn, e.g. a robot, is used, which lifts the waste bag in the gripper 12 of the handling device on the basis of a signal given to the control system CS by a sensor S1, S2, S3 of the sensor system first upwards and then the waste bag is transferred to the container 11 intended for the waste component F1 . . . Fn.

The grip of the gripper 12 of the handling device R1 . . . Rn, such as of a robot, can be adjusted in such a way that the gripper grips the waste bag only at its top edge. When the waste bag is in the grip of the gripper of the robot, the bag can be moved by the robot easily in a manner that is, per se, prior art.

When the sensors S1, S2, S3 of the sensor system detect the first waste bag 1 of a waste component to be separated from the conveyor 10, on the basis of the identifier 3 on the bag of the waste bag 1 and/or on the basis of the indicated content of the waste bag, the information is relayed from the sensor S1, S2, S3 of the sensor system to the control system CS, which controls the handling devices. In this case the handling device, which is adapted to transfer the waste bag of the waste component in question from the conveyor, grips the selected waste bag 1 that is on the conveyor belt of the conveyor 10, lifts the bag upwards and then transfers the selected bag to the side into the container of the waste component in question. If a sensor detects an RFID identifier, the waste bag is sorted in the first place on the basis of the information provided by the RFID identifier. If the sensor detects only a visual identifier, the waste bag is sorted on the basis of it. When a material detector gives an indication deviating from the identifier, the waste bag is sorted in a predetermined manner by transferring the bag e.g. into the mixed waste or e.g. into mixed waste containing metal, if a material detector that is one sensor gives a signal indicating metal.

The number of handling devices R1 . . . Rn, robots in the embodiment of the figure, needed in sorting must be defined e.g. according to the waste quantities of the waste components to be sorted. In this case, e.g. paper and biowaste can be large waste components in terms of their waste quantity, and metal or glass correspondingly smaller waste components in terms of their waste quantity.

A larger number of handling devices R1 . . . Rn can be used in sorting waste components that are large in terms of their waste quantity. There can be more handling devices, e.g. robots, than what is presented in FIG. 3.

Depending on the number of waste components F1 . . . Fn to be sorted and on the amount of waste of each waste component, waste bags provided with an identifier 3 can be flexibly sorted with the apparatus according to the invention.

In the sorting apparatus, or in the proximity of it, are the sensors S1, S2, S3 of the sensor system that read or detect the information, or at least some of the information, of each waste bag 1 brought on the conveyor 10. At least one sensor S1, S2, S3 of the sensor system is preferably of a type that is able to read the information in the memory of an RFID identifier 3 remotely from a sufficiently long distance away. The information is transmitted from the sensors S1, S2, S of the sorting apparatus e.g. to the control system CS of the system, on the basis of which information the handling means R1 . . . Rn and/or the conveyors 10 are controlled.

Information from the sensors S1, S2, S3 can be transmitted to the control system CS wirelessly or by wireline, using data transfer methods and systems that are, per se, known in the art.

The connection from the sensors can also be bidirectional, in which case information coming from the sensors S1, S2, S3 can be saved in the memory of an RFID identifier 3. In this case the sensor S1 is not just a reading device but instead is a device for reading/transmitting information.

An RFID identifier or some other machine-readable identifier can be used to register the amount of waste produced by a certain user, in which case the invoicing basis can be changed. On the other hand, a waste producer can be rewarded for sorting waste, e.g. by reducing the waste transport fees of waste that is fit for recycling.

The embodiment of the invention can be utilized by using as a waste bag the ordinary plastic carrier bags of a shop, which are closed with a closing means 2. The waste bag is filled with waste and closed e.g. by knotting its carrying loops. A typical way is to tie at first one knot, after which a closing means 2, preferably a sticker tape, is placed on top of the knot, and fixed over the knot of the carrier bag. After that a second knot can still be made with the carrying loops. The RFID identifier in this case remains at least partly protected and avoids transport damage. The closing means 2 in this case prevents the opening of the knots of the waste bag 1.

In the waste sorting center to which the waste bags 1 are transported conventionally with garbage trucks or in some other way, the waste bags 1 are sorted into different waste components F1 . . . Fn on the basis of the information provided by the identifiers 3 and/or on the basis of the indicated material. According to one embodiment each household is supplied with its own identifiers 3, e.g. closing means 2 or waste bags that comprise RFID identifiers. This assists sorting. In addition, by means of a closing means 2 and RFID identifier 3 according to the invention, or by means of a waste bag that comprises an identifier, it is easy to demonstrate where the costs of the waste handling system are incurred. Fees can thus be allocated to waste producers more accurately than earlier.

According to one preferred embodiment, households have a fixed waste charge and receive a credit for each waste bag sorted in a sorting center. Based on the automatic reading of RFID identifiers, the system can allocate the sorted waste by means of an information system so that the credit goes to the correct target.

Although a combination of a closing means 2 and an RFID identifier 3 is the most preferred embodiment, the system does not exclude an alternative wherein waste bags 1 comprising in advance an RFID identifier and/or machine-readably visual identifier, are, if desired, used instead of a closing means 2. This typically requires separate waste bags provided with an RFID identifier, for each waste component F1 . . . Fn.

Household waste packed into waste bags 1 is therefore brought to a sorting station in a garbage truck or in some other way. The waste bags 1 are transferred from the garbage truck or from another means of transport into an emptying area, from where the waste bags 1 are transferred on a conveyor, such as on a moving floor, a conveyor belt or on some other means, to the next conveyors 10, such as to conveyor belts. Waste bags can be separated from each other by means of the consecutive conveyor belts of conveyors moving at different speeds in such a way that when they arrive in the reading area 5 of the sensors S1, S2, S3 of the sensor system the waste bags 1 are separate from each other and can in this case be reliably identified and individualized.

One or more identifiers 3, such as RFID identifiers, the color of a bag, a barcode, letters, or other graphic or visual elements, can be used in identifying the waste bags 1, which identifiers can be read or identified with the sensors S1, S2, S3 of the sensor system. The sensors S1, S2, S3 can be optical, electromagnetic or ultrasound sensors, material detectors or other devices with which the waste component F1, F2, F3 . . . Fn of a waste bag 1 can be determined. In addition to identification, a sensor S1, S2, S3 can be a type with which also other properties about a waste bag 1 can be determined, e.g. the lateral location of a waste bag 1 on a conveyor belt 10 or the size and height of a waste bag 1. The sensors determining the location and size can be separate from the sensors S1, S2, S3 being used for actual identification. The measuring data to be identified from waste bags 1 can be used for controlling a handling device R1, R2, R3 . . . Rn, such as a sorting robot. This can improve sorting accuracy. On the basis of the size data measured from a waste bag 1, it can also be detected whether the waste bag 1 has been broken. Broken waste bags 1 almost certainly do not contain significant quantities of the desired waste component, in which case the remains of the waste bag 1 can be classified e.g. as mixed waste. Also the size limits for the maximum permitted size of a waste bag 1 can be defined. If a waste bag 1 is too large to fit between the conveyor and a handling device safely, all the handling devices R1 . . . Rn that are alongside the conveyor 10 can be controlled to avoid the overlarge waste bag. If a waste bag 1 is too large to fit through the reading area 5, such as an identification chamber, of the sensors, the whole sorting line can be stopped.

The sorting apparatus therefore typically comprises ultrasound sensors and/or optical sensors, with which the size (height and width) of the bags is measured. Size data can be useful information for controlling the sorting plant: whether a waste bag is really too large for the sorting apparatus, in which case it can be removed automatically in advance or allowed to go through on the conveyor into a waste component to be removed from the end of the conveyor, e.g. into the mixed waste, because the handling devices R1 . . . Rn are not able to handle the waste bag.

In one embodiment the sorting apparatus comprises a device for determining the weight of waste bags, e.g. a belt weigher, with which individual bags are weighed. In this case the weighing data can be connected to the identification data, e.g. to the RFID identifier data, in which case precise waste data, by weight per type of waste, specific to a waste producer is obtained.

The weight information of the waste bags can be used, as is the measuring data above, for removing in advance oversized or overweight waste bags from the conveyor or for allowing them to go through for removing them into a waste component from the end of the conveyor.

Also the sensor system or sorting apparatus can further comprise more advanced measuring technologies, e.g. an X-ray analyzer or NMR measuring or other such technology based on penetrating radiation. With them e.g. images of the waste of a waste bag 1 is obtained, from which images the desired points can be automatically analyzed with image analysis. With these methods it can be possible also to identify different types of materials and to ensure the purity of the waste and accuracy of the sorting insofar as the actual waste component F1 . . . Fn is really in the waste bag that according to the identifier should be. The sensor system can therefore give sensor information or analyzed sensor data to the control system CS.

Figure 4:
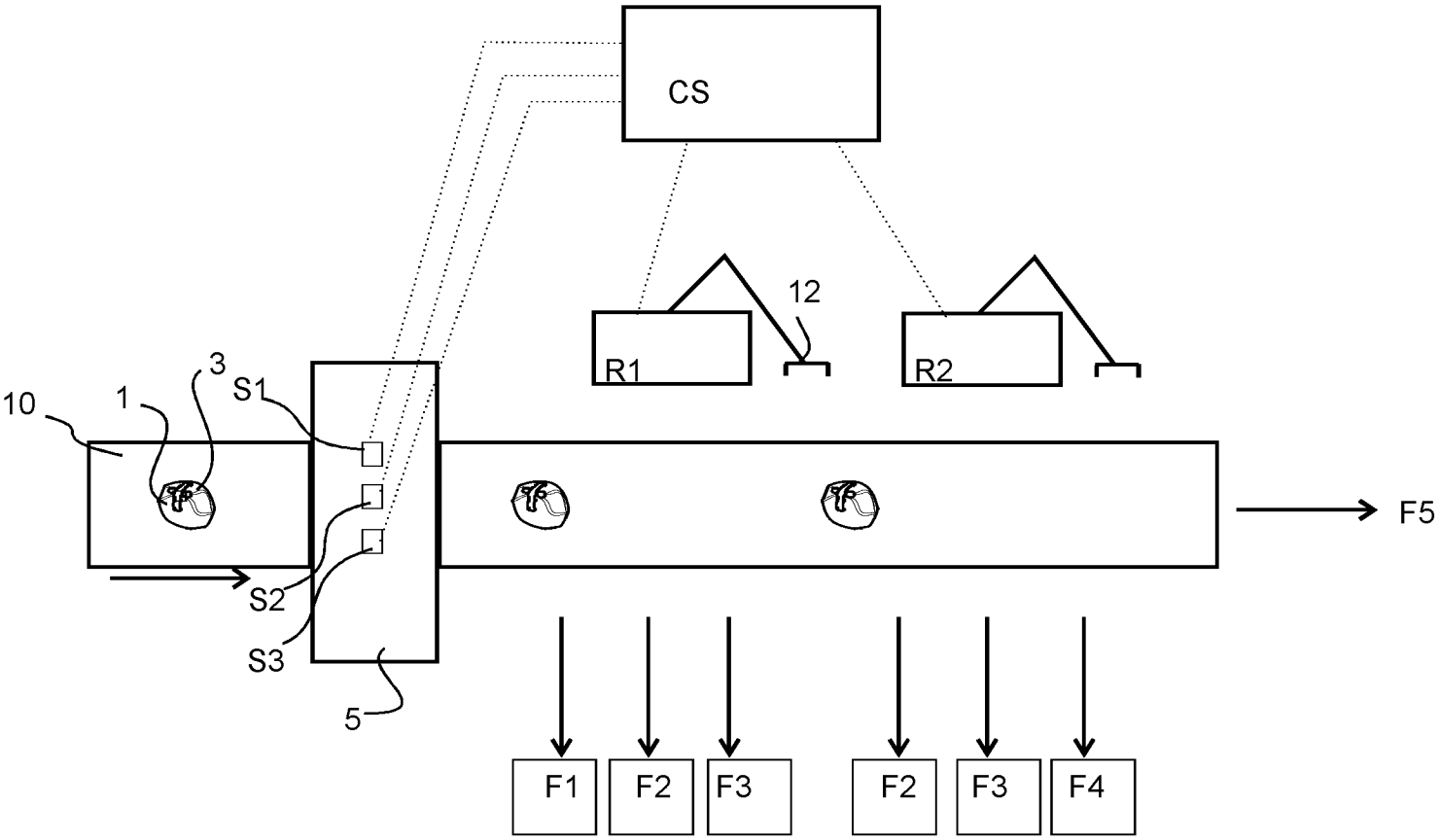
FIG. 4 presents a simplified and diagrammatic top view of an apparatus of an embodiment of the invention.

The control system CS keeps a record of the waste components F1, F2, F3 . . . Fn of identified waste bags 1 and it can, on the basis of the data, optimize the picking commands to be given to the handling devices R1, R2, R3 . . . Rn, such as to sorting robots. The handling devices R1 . . . Rn can sort the waste into a number of different waste components F1 . . . Fn. FIG. 4 illustrates the optimization of sorting. The waste bags 1 brought to the sorting station are transferred on the conveyor 10 to handling devices R1, R2, such as to sorting robots. The waste bags 1 are identified in the reading area 5 of the sensor system by a number of sensors S1, S2, S3, e.g. in an identification chamber, and the control system CS keeps a record of the waste components F1, F2 . . . Fn of the arriving waste bags. The first handling device R1, preferably a sorting robot, is programmed to pick components F1, F2 and F3 from the line. The second handling device R2, preferably a sorting robot, is programmed to pick components F2, F3 and F4. If a waste bag of component F1 arrives on the line, the system gives a picking command to the first handling device R1, such as a sorting robot, in which case the handling device transfers the waste bag off the conveyor into the container 11 for waste component F1. If waste components F2 and F1 arrive on the line, the first handling device R1 is not ordered to pick the component F2 even though it could do so, because the second handling device R2 can also pick a waste bag of component F2 and in this case the first handling device R1 can then pick the next arriving waste bag of component F1 from the line. In this case the sorting can be speeded up and thus the capacity of the sorting apparatus can be optimized.

Alternative operating procedures can also be programmed into the sorting system, e.g. during the emptying of the containers 11, e.g. transport containers, of the sorted components F1 . . . Fn. If the container of a waste component F1 . . . Fn fills up, the waste bags 1 of the waste component F1 . . . Fn in question can be allowed to pass through sorting, in which case the waste component in question ends up e.g. amongst the waste component F5, e.g. mixed waste, being conducted from the exit end of the conveyor 10. In this case the sorting apparatus does not need to stop during the change of the container 11 of one sorted component F1 . . . Fn, but instead the sorting can continue for the other components normally.

Different operating procedures for different combinations of waste components F1 . . . Fn can also be programmed into the sorting system. If identifiers for a number of waste components F1 . . . Fn have been erroneously arranged on a waste bag 1, the waste bag 1 can be sorted into a predetermined waste component or, if so needed, the waste bag can be conducted e.g. in amongst the mixed waste. For example, when the identifier is a paper & biowaste identifier, the waste bag can be sorted into biowaste but not into paper waste. In this case the waste bag is specified for sorting into a predetermined waste component.

Priorities for the different components F1 . . . Fn can also be programmed into the sorting system, in which case the weighted value of some components with respect to other components can be changed in the sorting specification. In a case in which the sorting robots functioning as handling devices R1 . . . Rn do not have time to sort all the components to be sorted from the conveyor, the waste components to be sorted can be selected on the basis of the value sequence of the components, the relative quantity of them, their physical size or some other property.

The handling devices R1 . . . Rn in the sorting system can also be of different sizes or of different types and they can have a different loading capacity. The handling devices R1-Rn can also have different types of grippers 12 to each other. For example, graspers or other picking tools that are suited for picking different types of components F1 . . . Fn from the line of the conveyor 10. In this case the different handling devices R1 . . . Rn can also be controlled with the control system CS on the basis of the information provided by the sensors of the sensor system to handle waste bags 1 that are different in their size and/or mass or to handle different waste components F1 . . . Fn.

The sorting system can also be utilized in the systems of the type of applications in which handling devices R1 . . . Rn, such as sorting robots, are able to pick waste components from different conveyors 10, e.g. from conveyors arranged parallel to each other.

Figure 5:
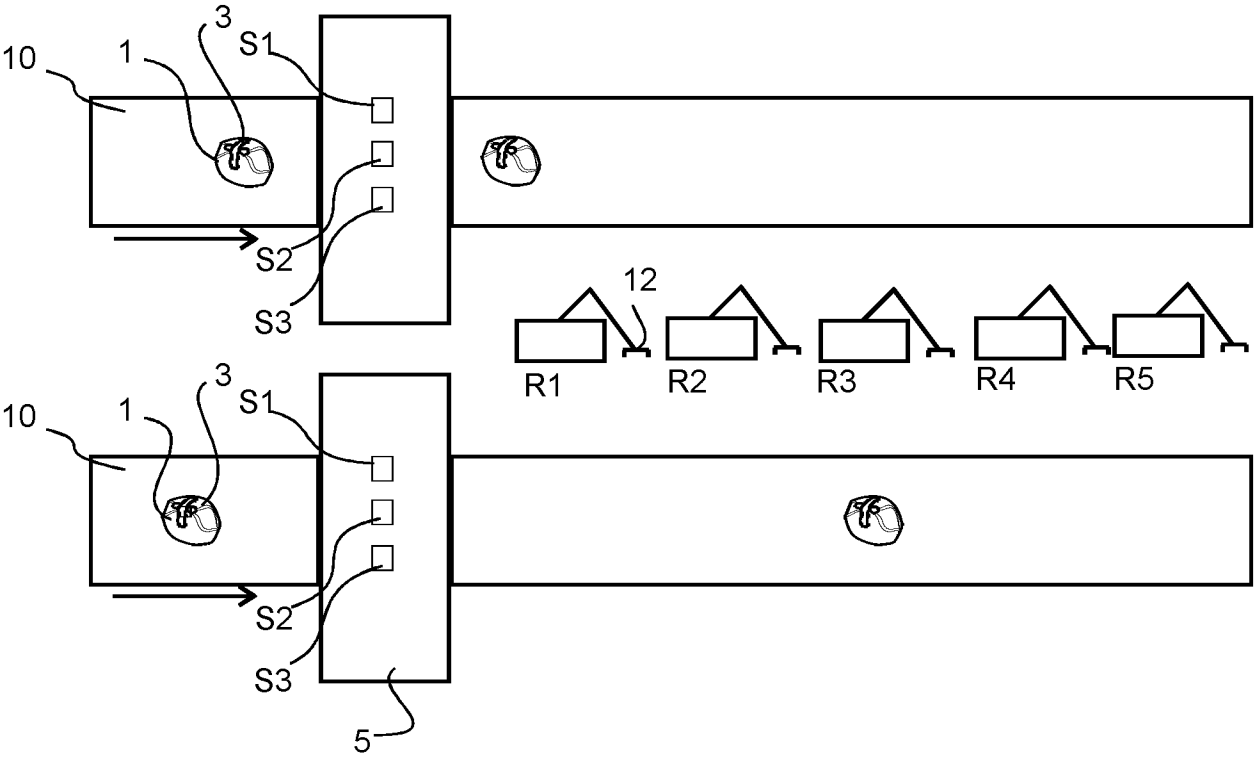
FIG. 5 presents a simplified and diagrammatic view of an apparatus of an embodiment of the invention.

FIG. 5 illustrates a sorting apparatus of a number of parallel conveyors 10, i.e. of a sorting line, the apparatus comprising a number of handling devices R1 . . . Rn, such as robots. There can be the desired number of handling devices, e.g. 1-n robots, on one line. With on handling device R1 . . . Rn, such as with a sorting robot, waste bags 1 can also be picked from one or more conveyors 10 and transferred to the container 11 intended for that waste component or to further processing. With the sorting system according to FIG. 5 each parallel conveyor 10 has its own reading area 5 with a number of sensors S1, S2, S3, which separately identify the waste bags 1 arriving on the conveyors in question. On the basis of the identified waste components of the waste bags 1, the control system CS can distribute or allocate the sorting to different handling devices, e.g. in order to achieve even loading of the different handling devices.

In the case according to FIG. 5 the system monitors the waste components of waste bags arriving on the conveyors 10 and if e.g. the identified waste bags 1 belonging to waste components on the first of the parallel conveyors 10 have been picked from the conveyor all the handling devices R1 . . . Rn can be controlled to pick the identified waste bags belonging to waste components from the second of the parallel conveyors.

In the case according to FIG. 5, in which there are a number of waste components to be sorted from a conveyor 10, i.e. from the line, by determining the sequence, location and/or quantity of waste components specified for the handling devices R1 . . . Rn, such as for sorting robots, the sorting capacity of a sorting plant can be optimized. When sorting a number of waste components, the control system of the sorting system keeps a record of the waste components of arriving waste bags and of the arrival sequence of the waste bags, for each specific conveyor. On the basis of such monitoring, the removal of components can be optimized for the handling devices that are programmed to remove the waste component in question.

Figure 6:
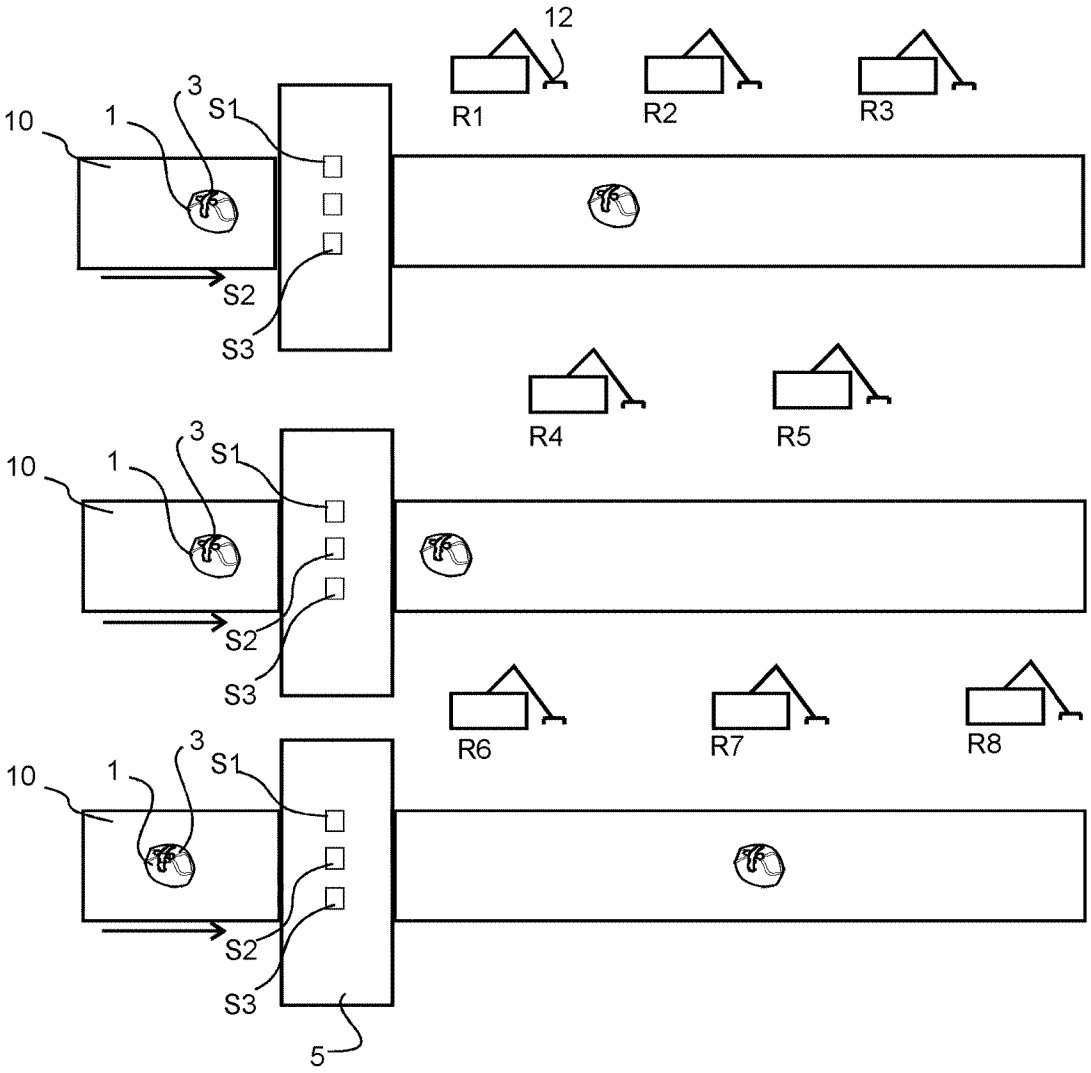
FIG. 6 presents a simplified and diagrammatic view of an apparatus of an embodiment of the invention.

The aforementioned sorting methods can also be used simultaneously in a sorting plant comprising handling devices R1 . . . Rn, such as sorting robots, that are able to pick from both one conveyor and from more than one conveyor 10, i.e. from the line. FIG. 6 illustrates an embodiment comprising handling devices R1 . . . Rn, such as sorting robots, that are able to pick from both one conveyor and from more than one conveyor 10, i.e. from the line.

With the sorting arrangement according to FIG. 6 the sorting capability of a sorting plant can be further improved, more particularly in a case in which one or more of the waste components to be sorted appear significantly more frequently than the other fractions to be sorted. The layout according to FIG. 5 can also be used if differing amounts of waste bags 1 arrive on different conveyors 10 or if the composition of arriving waste bags differs on different conveyors 10.

The versatile identification system according to the invention enables optimization of the control of the plant in different loading circumstances or during exceptional or servicing situations.

According to one embodiment it is advantageous to construct a sorting plant in such a way that it comprises at least two parallel handling lines, in a larger plant many handling lines. In this case it is easy to run an automated sorting plant at a lower capacity, when one or more lines are at a standstill, because operation can be guided to lines that are still running.

All the robots functioning as handling devices do not, in practice, extend to perform sorting of all the waste components, but typically one handling device is able to sort and pick from the conveyor waste bags 1 into from two to four different waste components F1 . . . Fn. The handling devices are, according to one embodiment, adapted to sort certain waste components, but mainly the operating ability of handling devices R1 . . . Rn that are side-by-side on the conveyor line is such that they are able to, at least partly, replace the work of one another. If now a lot of bags of the same component happen to come consecutively to a single line, a situation can arise in which e.g. in a plant of eight robots, only one or two robots are performing sorting work and the others are standing still because "their own waste components" are not coming. For this, smart control according to an embodiment of the invention is needed.

By means of the detector system, according to an embodiment of the invention, comprising a number of sensors, there is an abundance of information about the arriving waste bags 1, about their contents and about their properties, which information is used by means of the smart control system CS to employ the available sorting capacity optimally by guiding the material flows suitably with the handling devices R1 . . . Rn and with the conveyors 10.

Unlike control solutions of fixed construction that are already known in the art, the present smart system comprises numerous algorithms for controlling the plant according to the situation. The system can be self-learning, contain adaptive algorithms and develop its own operation continuously.

The invention thus relates to a method for sorting waste, in which method the waste or recycleable material intended for sorting is brought in waste bags 1 to the sorting apparatus, which comprises a conveyor, from which the waste bags belonging to different waste components are separated from each other by guiding them into containers according to the waste components or to further processing. In the method a waste bag 1, an identifier 3 arranged in connection with it and/or the content of the waste bag is identified with a sensor system, which comprises a number of sensors S1, S2, S3 monitoring different properties, which sensors essentially simultaneously read and/or identify a waste bag 1, an identifier 3 arranged in connection with it and/or the content of the waste bag when the waste bag 1 is transferred on the conveyor via the reading area of the sensors S1, S2, S3, and in which method on the basis of information coming from the sensors S1, S2, S3 the waste bags 1 are sorted into different waste components F1 . . . Fn using one or more of the handling devices R1, R2, R3 of the sorting apparatus. Of the many sensors S1, S2, S3 of the sensor system, at least one sensor is a material detector.

According to one embodiment, of the many sensors S1, S2, S3 of the sensor system, with at least one first sensor S1 an RFID identifier 3 of a waste bag 1 or of the closing means 2 of a waste bag is read.

According to one embodiment, of the many sensors S1, S2, S3 of the sensor system, with at least one second sensor S2 a waste bag 1 or a visual identifier connected to it is identified.

According to one embodiment, of the many sensors S1, S2, S3 of the sensor system, with at least one third sensor S3 the content of a waste bag 1 is identified. According to one embodiment the content of a waste bag is identified with a material detector, which is one of a number of sensors S1, S2, S3.

According to one embodiment, of the many sensors S1, S2, S3 of the sensor system, at least one third sensor S3 is a metal detector.

According to one embodiment the sensor system also comprises sensors with which one or more of the following is determined: the size of a waste bag, the position of a waste bag on the conveyor, the weight of a waste bag, which information is used in controlling the sorting apparatus.

According to one embodiment with the sensors of the sensor system many measurements, possibly hundreds of measurements, per second are performed.

According to one embodiment the waste bags 1 are sorted in the first place on the basis of the information received by at least one first sensor S1 from the RFID identifier 3 of a waste bag 1 or of a closing means 2, and in the second place on the basis of the information received by at least one second sensor S2 from a visual identifier of the waste bag.

According to one embodiment after at least one third sensor S3 has indicated that a waste bag contains material differing from the information provided by the first sensor S1 or by the second sensor S2, the waste bag 1 is guided in a predetermined manner into an applicable waste component F1 . . . Fn or into further processing.

According to one embodiment when at least one third sensor S3 is a metal detector and it indicates that there is metal in a waste bag 1, the waste bag 1 is sorted in a predetermined manner into an applicable waste component F1 . . . Fn or into further processing.

According to one embodiment if one of the waste components F1 . . . Fn to be sorted is a metal component, a waste bag 1 containing metal is sorted into a metal component, or if a separate metal component is not in use as a waste component F1 . . . Fn, a waste bag containing metal is sorted into mixed waste, from where metal is possibly removed in further processing.

According to one embodiment on the basis of the information provided by the sensors S1, S2, S3 of the sensor system, at least one robot, or part thereof, functioning as a handling device R1, R2, R3 is controlled with the control system CS in such a way that at least one handling device, or a part thereof, transfers the waste bags 1 to be sorted from the conveyor to the different waste components F1 . . . Fn on the basis of the information provided by the sensors.

According to one embodiment in the method the waste bags 1 are transferred from a number of parallel conveyors 10 by a number of handling devices R1, R2, R3 . . . Rn into different waste components in a sorted manner.

According to one embodiment the waste bags 1 to be sorted are moved on the conveyor 10 from the first end of the conveyor towards the second end, along the route of which conveyor waste bags 1 are transferred with the handling devices R1 . . . Rn into different components on the basis of the information provided by a sensor S1, S2, S3 of the sensor system.

According to one embodiment information about arriving waste bags 1 is received from a number of sensors of the sensor system, which information is used by means of a smart control system CS to optimally employ the available sorting capacity by suitably controlling with the handling devices R1 . . . Rn and with the conveyor 10 the material flows composed of waste bags 1 to be sorted.

According to one embodiment in the method a freely selectable carrier bag, bag or sack 1, such as a plastic carrier bag, plastic sack or plastic bag, is used as a waste bag, in which case the identifier 3 is arranged on the waste bag, on the closing means 2 of it.

According to one embodiment in the method a reading area 5 of the sensors S1, S2, S3 of the sensor system are arranged in connection with or in the proximity of the conveyor 10, a number of sensors S1, S2, S3 being arranged in which area, on the basis of the information read by which sensors a number of robots, or parts thereof, functioning as handling devices R1, R2, R3, R4, R5 are controlled by the control system CS in such a way that the handling devices, or at least some of them, transfer the waste bags 1 to be sorted from the conveyor to the different components on the basis of the information provided by the sensors S1, S2, S3 of the sensor system.

According to one embodiment at least some of the waste bags 1 are conducted on the conveyor 103 directly to further processing or into a container.

According to one embodiment in the method a sorted waste component F1 . . . Fn is further processed by transferring it to waste incineration, which can be preceded by one or more other further processing phases.

The invention also relates to an apparatus for sorting waste, to which apparatus the waste or recycleable material intended for sorting is brought in waste bags 1, which apparatus comprises a conveyor 10, from which the waste bags 1 belonging to different waste components are separated from each other by guiding them into containers according to the components or to further processing. The apparatus comprises a sensor system, which comprises a number of sensors S1, S2, S3 monitoring different properties, which sensors are adapted to essentially simultaneously read and/or identify a waste bag 1, an identifier 3 arranged in connection with it and/or the content of the waste bag when the waste bag 1 is in the reading area 5 of the sensors S1, S2, S3, and that the apparatus comprises a control system CS, which is adapted to receive information coming from the sensors S1, S2, S3 and on the basis of it is fitted to control one or more handling devices R1 . . . Rn of the sorting apparatus in such a way that the waste bags 1 are sorted from the conveyor 10 into different waste components F1 . . . Fn. Of the many sensors S1, S2, S3 of the sensor system, at least one sensor is a material detector.

According to one embodiment, of the many sensors S1, S2, S3 of the sensor system, at least one first sensor S1 is adapted to read an RFID identifier 3 of a waste bag 1 or of the closing means 2 of a waste bag.

According to one embodiment, of the many sensors S1, S2, S3 of the sensor system, at least one second sensor S2 is adapted to identify a waste bag 1 or a visual identifier connected to it.

According to one embodiment, of the many sensors S1, S2, S3 of the sensor system, at least one third sensor S3 is adapted to identify the content of a waste bag 1. According to one embodiment a material detector is adapted to identify the content of a waste bag, the detector being one of the many sensors S1, S2, S3.

According to one embodiment, of the many sensors S1, S2, S3 of the sensor system, at least one third sensor S3 is a metal detector.

According to one embodiment the sensor system also comprises sensors with which it is adapted that one or more of the following is determined: the size of a waste bag 1, the position on the conveyor 10 of a waste bag 1, the weight of a waste bag 1.

According to one embodiment the waste bags 1 are adapted to be sorted with the apparatus in the first place on the basis of the information received by at least one first sensor S1 from the RFID identifier 3 of a waste bag 1 or of the closing means 2 of a waste bag 1, and in the second place on the basis of the information received by at least one second sensor S2 from a visual identifier of the waste bag.

According to one embodiment after at least one third sensor S3 has indicated that a waste bag contains material differing from the information provided by the first sensor S1 or by the second sensor S2, the waste bag 1 is adapted to be guided in a predetermined manner into an applicable waste component F1 . . . Fn or into further processing.

According to one embodiment when at least one third sensor S3 is a metal detector and it indicates that there is metal in a waste bag 1, the waste bag 1 is adapted for sorting in a predetermined manner into an applicable waste component F1 . . . Fn or into further processing.

According to one embodiment if one of the waste components F1 . . . Fn to be sorted is a metal component, a waste bag 1 containing metal is adapted for sorting into a metal component, or if a separate metal component is not in use as a waste component F1 . . . Fn, a waste bag containing metal is adapted for sorting into mixed waste, from where metal is possibly adapted to be removed in further processing.

According to one embodiment on the basis of the information provided by the sensors S1, S2, S3 of the sensor system, at least one robot, or part thereof, functioning as a handling device R1, R2, R3 is adapted to be controlled with the control system CS in such a way that at least one handling device, or a part thereof, is adapted to transfer the waste bags 1 to be sorted from the conveyor to the different waste components F1 . . . Fn on the basis of the information provided by the sensors.

According to one embodiment the apparatus comprises a number of parallel conveyors 10 and handling devices R1, R2, R3 . . . Rn common to the conveyors.

According to one embodiment the waste bags 1 to be sorted are adapted to be moved on the conveyor 10 from the first end of the conveyor towards the second end, along the route of which conveyor waste bags 1 are adapted to be transferred with the handling devices R1 . . . Rn into different components on the basis of the information provided by the sensors S1, S2, S3 of the sensor system According to one embodiment, when a special closing means 2 provided with an identifier 3 is used on a waste bag, the waste bag is a freely selectable carrier bag, bag or sack 1, such as a plastic carrier bag, plastic sack or plastic bag.

According to one embodiment a reading area 5 of the sensors S1, S2, S3 of the sensor system is arranged in connection with or in the proximity of the conveyor 10, a number of sensors S1, S2, S3 being arranged in which area, on the basis of the information read by which sensors the control system CS is adapted to control a number of robots, or parts thereof, functioning as handling devices R1, R2, R3, R4, R5 in such a way that the handling devices, or at least some of them, are adapted to transfer the waste bags 1 to be sorted from the conveyor 10 to the different components on the basis of the information provided by the sensors S1, S2, S3 of the sensor system.

According to one embodiment at least some of the waste bags 1 are adapted to be conducted by the conveyor 10 directly to further processing or into a container.

According to one embodiment the apparatus is fitted in connection with a waste incineration plant, in which case the further processing applicable to a sorted waste component F1 . . . Fn is waste incineration, which can be preceded by one or more other further processing phases.

The invention also relates to a system for sorting waste, in which the waste or recycleable material intended for sorting is brought in waste bags 1, on at least some of which is an identifier 3, which determines the waste component of the material arranged in the waste bag, which apparatus comprises a conveyor 10, to which the waste bags 1 are brought and from which the waste bags 1 belonging to different waste components are separated from each other by guiding them into containers according to the components or into further processing. The system comprises a sensor system, which comprises a number of sensors S1, S2, S3 monitoring different properties, which sensors are adapted to essentially simultaneously read and/or identify a waste bag 1, an identifier 3 arranged in connection with it and/or the content of the waste bag when the waste bag 1 is in the reading area 5 of the sensors S1, S2, S3, and that the apparatus comprises a control system CS, which is adapted to receive information coming from the sensors S1, S2, S3 and on the basis of it is fitted to control one or more handling devices R1 . . . Rn of the sorting apparatus in such a way that the waste bags 1 are sorted from the conveyor 10 into different waste components F1 . . . Fn. Of the many sensors S1, S2, S3 of the sensor system, at least one sensor is a material detector.

The invention also relates to a control system CS, which is adapted to receive sensor information or analyzed sensor data and on the basis of it to control an apparatus, or part of an apparatus, according to what is presented above for sorting waste.

According to one embodiment the control system CS is adapted to receive information or analyzed sensor data coming from the sensors S1, S2, S3, preferably sensors monitoring different properties, and on the basis of it to control one or more of the handling devices R1, R2, R3 of the sorting apparatus.

According to one embodiment information about arriving waste bags 1 is received from a number of sensors S1, S2, S3 of the sensor system, which information is used by means of a smart control system CS to optimally employ the available sorting capacity by suitably controlling with the handling devices R1 . . . Rn and with the conveyor 10 the material flows composed of waste bags 1 to be sorted.

According to one embodiment on the basis of the information read by the sensors S1, S2, S3, a number of robots, or parts thereof, functioning as handling devices R1, R2, R3, R4, R5 are controlled by the control system CS in such a way that the handling devices, or at least some of them, transfer the waste bags 1 to be sorted from the conveyor to the different components on the basis of the information provided by the sensors S1, S2, S3 of the sensor system.

According to one embodiment the system comprises an apparatus mentioned in the preceding.

It is obvious to the person skilled in the art that the invention is not limited to the embodiments presented above, but that it can be varied within the scope of the claims presented below. The characteristic features possibly presented in the description in conjunction with other characteristic features can also, if necessary, be used separately to each other.

The invention claimed is:

1. A method for sorting waste, comprising:

bringing the waste intended for sorting in waste bags to a sorting apparatus, which comprises a conveyor, separating the waste bags belonging to different waste components from each other by guiding them into containers according to the waste components or to further processing, wherein a waste bag, an identifier arranged in connection with the waste bag and/or the content of the waste bag is identified with a sensor system, which comprises a plurality of sensors monitoring different properties, which sensors essentially simultaneously read and/or identify the waste bag, the identifier arranged in connection with the waste bag and/or the content of the waste bag when the waste bag is transferred on the conveyor via a reading area of the sensors, wherein at least one sensor of the plurality of sensors is a material detector which identifies the content of the waste bag, wherein, on the basis of information coming from the sensors, the waste bags are sorted into different waste components using one or more handling devices of the sorting apparatus, and wherein:

the waste bags are primarily sorted on the basis of the information received by at least one first sensor of the plurality of sensors, from an RFID identifier of a waste bag or of a closure, and secondarily on the basis of the information received by at least one second sensor of the plurality of sensors from a visual identifier of the waste bag; or after the material detector indicates that a waste bag contains material differing from the information provided by at least one third sensor of the plurality of sensors, the waste bag is guided in a predetermined manner into an applicable waste component or into further processing, and arranging the at least one first sensor, the at least one second sensor and the at least one third sensor of the plurality of sensors in a row perpendicular to a travel direction of the conveyor.

2. The method according to claim 1, wherein the material detector is a metal detector.

3. The method according to claim 1, wherein the sensor system also comprises sensors with which one or more of the following is determined: the size of a waste bag, the position of a waste bag on the conveyor, the weight of a waste bag, which information is used in controlling the sorting apparatus.

4. The method according to claim 1, wherein when the material detector indicates that there is metal in a waste bag, the waste bag is sorted in a predetermined manner into an applicable waste component or into further processing.

5. The method according to claim 1, wherein if one of the waste components to be sorted is a metal component, a waste bag containing metal is sorted into a metal component, or if a separate metal component is not in use as a waste component, a waste bag containing metal is sorted into mixed waste, from where metal is removed in further processing.

6. The method according to claim 1, wherein on the basis of the information provided by the sensors of the sensor system, at least one robot, or part thereof, functioning as a handling device is controlled with a control system in such a way that at least one handling device, or a part thereof, transfers the waste bags to be sorted from the conveyor to the different waste components on the basis of the information provided by the sensors.

7. The method according to claim 1, further comprising transferring the waste bags from a number of parallel conveyors by a number of handling devices into different waste components in a sorted manner.

8. The method according to claim 1, further comprising moving the waste bags to be sorted on the conveyor from a first end of the conveyor towards a second end of the conveyor, along the route of which conveyor waste bags are transferred with the handling devices into different components on the basis of the information provided by a sensor of the sensor system.

9. The method according to claim 1, further comprising receiving information about arriving waste bags from the plurality of sensors of the sensor system, which information is used by means of a smart control system to optimally employ the available sorting capacity by suitably controlling with the handling devices and with the conveyor the material flows composed of waste bags to be sorted.

10. The method according to claim 1, further comprising using a freely selectable carrier bag, bag or sack as a waste bag, and arranging the identifier on the waste bag or one the closure of the waste bag.

11. The method according to claim 1, further comprising arranging the reading area of the plurality of sensors of the sensor system in connection with or in the proximity of the conveyor, the plurality of sensors being arranged in the reading area, on the basis of the information read by which sensors a number of robots, or parts thereof, functioning as handling devices are controlled by the control system in such a way that the handling devices transfer the waste bags to be sorted from the conveyor into the different components on the basis of the information provided by the sensors of the sensor system.

12. The method according to claim 1, wherein at least some of the waste bags are conducted on the conveyor directly to further processing or into a container.

13. The method according to claim 1, further comprising further processing a sorted waste component by transferring the sorted waste component to waste incineration, which can be preceded by one or more other further processing phases.

14. An apparatus for sorting waste, wherein the waste intended for sorting is brought in waste bags, comprising:

a conveyor, from which the waste bags belonging to different waste components are separated from each other by guiding them into containers according to the waste components or to further processing, a sensor system, the sensor system comprising a plurality of sensors monitoring different properties, which sensors are adapted to essentially simultaneously read and/or identify a waste bag, an identifier arranged in connection the waste bag and/or the content of the waste bag when the waste bag is in a reading area of the sensors, wherein at least one sensor of the plurality of sensors is a material detector configured to identify content of the waste bag, wherein a control system, which is adapted to receive information coming from the sensors and is configured to control one or more handling devices of the sorting apparatus in such a way that the waste bags are sorted from the conveyor into different waste components, wherein:

the waste bags are primarily sorted on the basis of the information received by at least one first sensor of the plurality of sensors, from an RFID identifier of a waste bag or of a closure, and secondarily on the basis of the information received by at least one second sensor of the plurality of sensors from a visual identifier of the waste bag; or after the material detector indicates that a waste bag contains material differing from the information provided by at least one third sensor of the plurality of sensors, the waste bag is guided in a predetermined manner into an applicable waste component or into further processing, and wherein the at least one first sensor, the at least one second sensor and the at least one third sensor of the plurality of sensors are arranged in a row perpendicular to a travel direction of the conveyor.

15. The apparatus according to claim 14, wherein the at least one first sensor of the plurality of sensors is adapted to read an RFID identifier of a waste bag or of the closure of a waste bag.

16. The apparatus according to claim 14, wherein the at least one second sensor of the plurality of sensors is adapted to identify a waste bag or a visual identifier connected to the waste bag.

17. The apparatus according to claim 14, wherein the material detector is a metal detector.

18. The apparatus according to claim 14, wherein the sensor system also comprises sensors with which the sensor system is adapted that one or more of the following is determined: the size of a waste bag, the position on the conveyor of a waste bag, the weight of a waste bag.

19. The apparatus according to claim 14, wherein when the material detector indicates that there is metal in a waste bag, the waste bag is adapted for sorting in a predetermined manner into an applicable waste component or into further processing.

20. The apparatus according to claim 14, wherein if one of the waste components to be sorted is a metal component, a waste bag containing metal is adapted for sorting into a metal component, or if a separate metal component is not in use as a waste component, a waste bag containing metal is adapted for sorting into mixed waste, from where metal is removed in further processing.

21. The apparatus according to claim 14, wherein on the basis of the information provided by the sensors of the sensor system, at least one robot, or part thereof, functioning as a handling device is adapted to be controlled with the control system in such a way that at least one handling device, or a part thereof, is adapted to transfer the waste bags to be sorted from the conveyor into the different waste components on the basis of the information provided by the sensors.

22. The apparatus according to claim 14, wherein the apparatus comprises a number of parallel conveyors and handling devices common to the conveyors.

23. The apparatus according to claim 14, wherein the waste bags to be sorted are adapted to be moved on the conveyor from a first end of the conveyor towards the second end of the conveyor, along the route of which conveyor waste bags are adapted to be transferred with the handling devices into different components on the basis of the information provided by the sensors of the sensor system.

24. The apparatus according to claim 14, wherein when a special closure provided with an identifier is used on a waste bag, the waste bag is a freely selectable carrier bag, bag or sack.

25. The apparatus according to claim 14, wherein the reading area of the sensors of the sensor system is arranged in connection with or in the proximity of the conveyor, the plurality of sensors being arranged in which area, on the basis of the information read by which sensors the control system is adapted to control a number of robots, or parts thereof, functioning as handling devices in such a way that the handling devices, or at least some of them, are adapted to transfer the waste bags to be sorted from the conveyor to the different components on the basis of the information provided by the sensors of the sensor system.

26. The apparatus according to claim 14, wherein at least some of the waste bags adapted to be conducted by the conveyor directly to further processing or into a container.

27. The apparatus according to claim 14, wherein the apparatus is fitted in connection with a waste incineration plant, in which case the further processing applicable to a sorted waste component is waste incineration, which can be preceded by one or more other further processing phases.

28. A system for sorting waste, wherein the waste intended for sorting is brought in waste bags, on at least some of which is an identifier, which determines the waste component of the material arranged in a waste bag, comprising:

a conveyor, to which the waste bags are brought and from which the waste bags belonging to different waste components are separated from each other by guiding them into containers according to the components or into further processing, a sensor system, the sensor system comprising a plurality of sensors monitoring different properties, which sensors are adapted to essentially simultaneously read and/or identify a waste bag, an identifier arranged in connection with the waste bag and/or the content of the waste bag when the waste bag is in a reading area of the sensors, at least one sensor of the plurality of sensors is a material detector configured to identify content of the waste bag, and a control system, the control system configured to receive information coming from the sensors and control one or more handling devices of the sorting apparatus in such a way that the waste bags are sorted from the conveyor into different waste components, wherein:

the waste bags are primarily sorted on the basis of the information received by at least one first sensor of the plurality of sensors, from an RFID identifier of a waste bag or of a closure, and secondarily on the basis of the information received by at least one second sensor of the plurality of sensors from a visual identifier of the waste bag; or after the material detector indicates that a waste bag contains material differing from the information provided by at least one third sensor of the plurality of sensors, the waste bag is guided in a predetermined manner into an applicable waste component or into further processing, and wherein the at least one second sensor and the at least one third sensor of the plurality of sensors are arranged in a row perpendicular to a travel direction of the conveyor.

29. The method according to claim 1, further comprising providing the RFID tag on the closure and further providing at least one additional identifier on the closure.

30. The apparatus according to claim 14, wherein the RFID tag is on the closure and at least one additional identifier is on the closure.

31. The system according to claim 28, wherein the RFID tag is on the closure and at least one additional identifier is on the closure.

* * * * *